United States Patent [19]

Kimblad

[11] Patent Number: 4,669,619

[45] Date of Patent: Jun. 2, 1987

[54] DEVICE AND METHOD FOR TRANSPORTING A LOAD BY CABLE

[75] Inventor: Folke Kimblad, Tarfalla, Sweden

[73] Assignee: Sonnig, S.A., Fribourg, Switzerland

[21] Appl. No.: 592,877

[22] Filed: Mar. 23, 1984

[30] Foreign Application Priority Data

Mar. 25, 1983 [CH] Switzerland ..... 1656/83

[51] Int. Cl.[4] ..... B66C 13/40

[52] U.S. Cl. ..... 212/160; 212/77; 212/96; 212/122; 212/125; 180/168; 104/303

[58] Field of Search ..... 212/149, 153, 160, 207, 212/71, 76, 77, 94, 96, 98, 122, 124, 125; 104/98, 173 R, 173 ST, 182, 201, 235, 236, 284, 303; 180/167–169

[56] References Cited

U.S. PATENT DOCUMENTS

| | | | |
|---|---|---|---|
| 2,822,937 | 2/1958 | Fox | 104/303 |
| 3,437,315 | 4/1969 | McDonald | 212/76 |
| 3,714,625 | 1/1973 | Fayling | 180/167 |
| 3,805,706 | 4/1974 | Bancel | 104/173 ST |
| 3,922,972 | 12/1975 | Junes . | |
| 4,002,119 | 1/1977 | Halley | 102/21 |
| 4,109,799 | 8/1978 | Munn | 212/122 |
| 4,164,289 | 8/1979 | Haliewicz | 212/76 |
| 4,226,187 | 10/1980 | Paulsen et al. | 104/173 ST |
| 4,463,906 | 8/1984 | Reinke et al. | 180/167 |
| 4,515,281 | 5/1985 | Maki | 212/122 |

FOREIGN PATENT DOCUMENTS

| | | |
|---|---|---|
| 2424062 | 11/1975 | Fed. Rep. of Germany . |
| 355472 | 8/1961 | Switzerland . |
| 2096958 | 10/1982 | United Kingdom . |

*Primary Examiner*—Joseph F. Peters, Jr.
*Assistant Examiner*—Stephen P. Avila
*Attorney, Agent, or Firm*—Sandler & Greenblum

[57] ABSTRACT

A self-driven transporting unit with a magnetic detector which is propelled along a cable by a drive wheel having spokes arranged in two rows forming a V-shape. The cable is magnetized and mounted in a fixed manner. The spoke arrangement enables the drive wheel to engage with the cable. A programmable electronic control system permits pre-selection of the distance to be covered by the transporting unit and the drop height to which the load is lowered away from the self-driven transporting unit.

28 Claims, 5 Drawing Figures

DEVICE AND METHOD FOR TRANSPORTING A LOAD BY CABLE

BACKGROUND OF THE INVENTION

1. Technical Field

The invention relates to an apparatus and method for automatically transporting material by cable to a selected location.

2. Discussion of Prior Art

In the most widely known devices and methods for transporting by cable, the transporting apparatus is permanently mounted on the cable and it is the cable, rather than the transport, which moves. These devices suffer from the disadvantage that they are very large structurally, and they require powerful driving stations, if only to move the entire cable mass. Furthermore, the moving cable must be supported by pylons that are spaced along the entire route of the cable. Adequate support for the cable also requires that the pylons be of considerable diameter and be equipped with pulleys that are provided with anti-derailing devices and are mounted so that they are orientable in every plane. While the expense of these moving systems can be justified in some applications, such as transporting skiers or large machinery, many uses of these systems are prohibitively expensive. In particular, moving cable devices for transporting explosives for the controlled triggering of avalanches have generally proven to be very expensive.

SUMMARY OF THE INVENTION

The present invention, in the preferred embodiment comprises a cable and a self-driven transporting unit which travels along the cable. The unit is provided with at least one drive wheel having an engaging means for engaging with the cable. The engaging means is formed from two rows of radially extending spokes, wherein each spoke has one end attached to the circumference of the drive wheel and the opposite end oriented to guide the cable toward the drive wheel. The two rows of spokes form a diverging shape and the spacing of the spokes situate a spoke in one row opposite a spoke in the opposing row such that all spokes are paired. The opening angle of the diverging spokes is about 11 degrees and the spacing of the spokes along the circumference of the drive wheel is a multiple of at least one of the pitch of the cable. The spoke arrangement, therefore, can embed into ice coating the cable and thereby engage the cable. This arrangement can drive the self-driven transporting unit on frosted cable having a gradient up to 80% and non-frosted cable having a gradient of at least 100%. In addition the cross-section of each spoke can, for example, be circular or triangular. The triangular shape is particularly useful for breaking ice and firmly embedding the spoke into the ice.

The drive wheel is driven by a compound type electric motor through a screw reducing gear. Furthermore, a spoke scraper plate is attached to the drive wheel in order that material covering the spokes can be scraped off when the drive wheel is rotated. A front scraper plate is also attached to the self-driven transporting unit in order to clear excess material off of the cable before being passed over by the self-driven transporting unit.

The self-driven transporting unit is also provided with a magnetic detector for sensing magnetized zones in the cable. The magnetic detector comprises a holding rod connecting the magnetic detector to the self-driven transporting unit; a nylon runner which is adapted to roll along the cable and hold the magnetic detector closely to the cable; a pair of soft iron feeding heads which form a housing for the magnetic detector and a reed switch assembly. The reed switch assembly comprises two small plates whose ends are separated by a small space; two wires connected to the opposite end of each plate and a glass tube surrounding the small plates. The two wires connect, in turn, to a translation pulse counter. In operation, the counter is pulsed when the spaced ends of the small plates come into contact over a magnetized zone of the cable.

The translation pulse counter is located in a case which is coupled to the electric motor. A battery for energizing the self-driven transporting unit is also contained in the case. In addition, the case contains a winch which is adapted to raise and lower a load carried by the self-driven transporting unit. The case also contains an electronic pulse counter which registers the drop height of the load when it is raised or lowered by the winch. An aerial is attached to the exterior of the case and a radio receiver, which is also contained in the case, is connected to the aerial. As a result, the self-driven transporting unit can be operated by remote control. The self-driven transporting unit is also sufficiently lightweight to be easily carried by hand as it weighs about 15 to 18 kilograms.

The transporting unit is mounted on a fixed cable. The cable has at least one section which is subdivided into discrete magnetized zones of equal length which are separated along the length of the cable by non-magnetized zones of equal length.

The invention is further provided as a method for transporting by cable. The method involves a self-driven transporting apparatus having a magnetic detector and a cable magnetized into discrete magnetic zones. The method involves moving a load along the cable the length of the programmed translation distance. The load is then lowered to the programmed drop height. After the load has been unloaded the self-driven transporting unit returns along the cable to the mounting point.

The selected distance is determined in the self-driven transporting unit when the number of magnetized zones of the cable passed over by the self-driven transporting unit is equal to the pre-programmed translation distance. The magnetized zones are counted by the translation counter which is energized by the magnetic detector each time a magnetized area is passed over. The pre-selected translation and drop height distances are programmed into the transporting unit by employing digital readout screens which are connected to the self-driven transporting unit through a central processing unit. Furthermore, the self-driven transporting unit is automatically returned to the mounting point by triggering off reverse motion of the electric motor by means of an-end-of-travel contact on the winch. Unloading is accomplished by lowering a load by an automatic winch controlled by the electronic pulse counter; stopping the winch once the load reaches the pre-programmed drop height; maintaining the winch in a stopped condition for a given time period; and then raising the winch once the time period has ended. The time period for maintaining the winch in a stopped condition is controlled by a time switch.

A method is further provided wherein the cable is magnetized into discrete zones of a pre-determined length and separated by non-magnetized zones which are also of a pre-determined length and then moving a mobile apparatus over the zones such that a magnetic detector counts the zones and stops the mobile apparatus at the desired distance.

According to another aspect of the invention, a load can be transported by cable by remote control. The method comprises mounting a self-driven transport on a cable; energizing the self-driven transporting unit by remote control so that it can move along the cable in one direction; stopping the self-driven transporting unit by remote control once it has reached a desired destination; lowering a load from the transporting unit by remote control; unloading the load; and returning the self-driven transporting unit to the mounting point. Remote control of the self-driven transporting unit is accomplished by radio frequency communications.

A second embodiment provides for transporting explosives by cable. The apparatus comprises a self-driven transporting unit which travels along a cable and is provided with at least one drive wheel having an engaging means for contacting the cable and propelling the transporting unit along the cable. The self-driven transporting unit further comprises a winch and winch cable which raises and lowers the explosive. An ignition device is appropriately connected to the self-driven transporting unit and one end of a slow fuse is attached to the ignition device. The opposite end of the fuse is connected to the explosive so that ignition of the fuse will delay detonation until the transporting unit has cleared the detonation site. In addition, a release connection is provided having one end attached to the winch cable and an opposite end attached to the explosive. The connection releases the explosive from the cable.

A further embodiment of the present invention provides a method for transporting and detonating an explosive by cable. The method involves programming a pre-selected translation distance and drop height into a self-driven transporting unit; mounting the self-driven transporting unit on a cable; attaching an explosive to the self-driven transporting unit; transporting the explosive along the cable by energizing the drive wheel of the transporting unit; stopping the self-driven transporting unit at the programmed translation distance; lowering the explosive to the programmed drop height; detonating the explosive; and then returning the self-driven transporting unit along the cable to the mounting point.

Another significant embodiment of the invention provides an apparatus that automatically moves over a preselected distance. The apparatus comprises a mobile unit having a magnetic detector and a programmable counter; a means for stopping the mobile unit; a surface over which the unit travels which has at least one section divided into discrete magnetic zones; and a means for programming a desired distance. In operation, the apparatus moves over the surface counting the zones in its counter and stops at the number of counts equivalent to the desired distance.

BRIEF DESCRIPTION OF THE DRAWINGS

The invention will be more clearly understood with reference to the following description which is given by way of example and refers to the accompanying drawings, in which.

DETAILED DESCRIPTION OF THE INVENTION

The present invention has as one of its particular objectives to overcome the problems associated with the expensive designs of the prior art by making use of a self-driven transporting unit of simple design and of small size which moves along a fixed cable and is considerably smaller and, thereby considerably less expensive, than its predecessors.

The present invention provides a device for transporting by cable which makes use of a self-driven transporting unit which is particularly useful for transporting explosives intended for the controlled triggering of avalanches. The self-driven transporting unit is designed such that it can easily move on a cable having a gradient of more than 100% and up to gradients of about 80% on ice-frosted cable. The ascending ability of this system derives from a drive wheel arrangement having spokes oriented for engaging the cable. In addition, the device is provided with an electronic distance-pre-selection and drop-height control system which allows an explosive or other desired object to be transported to a a desired location and lowered to a desired height. In particular, distance is pre-selected by magnetization of the cable in selected zones and subsequent detection of these magnetized zones by a detector location on the transporting device which is comprised of a magnetic contact surrounded by a glass tube.

Compared to the prior art, therefore, the advantages of the present devices are substantial and obvious: the structure of the cable pylon installation is considerably reduced; the transporting device is relatively small in size and can be easily transported on the back of an operator from one place to another; and the transporting device can be used on an indeterminate number of installations. Further, in comparison with known devices, the present device is substantially less expensive.

Figure 1:
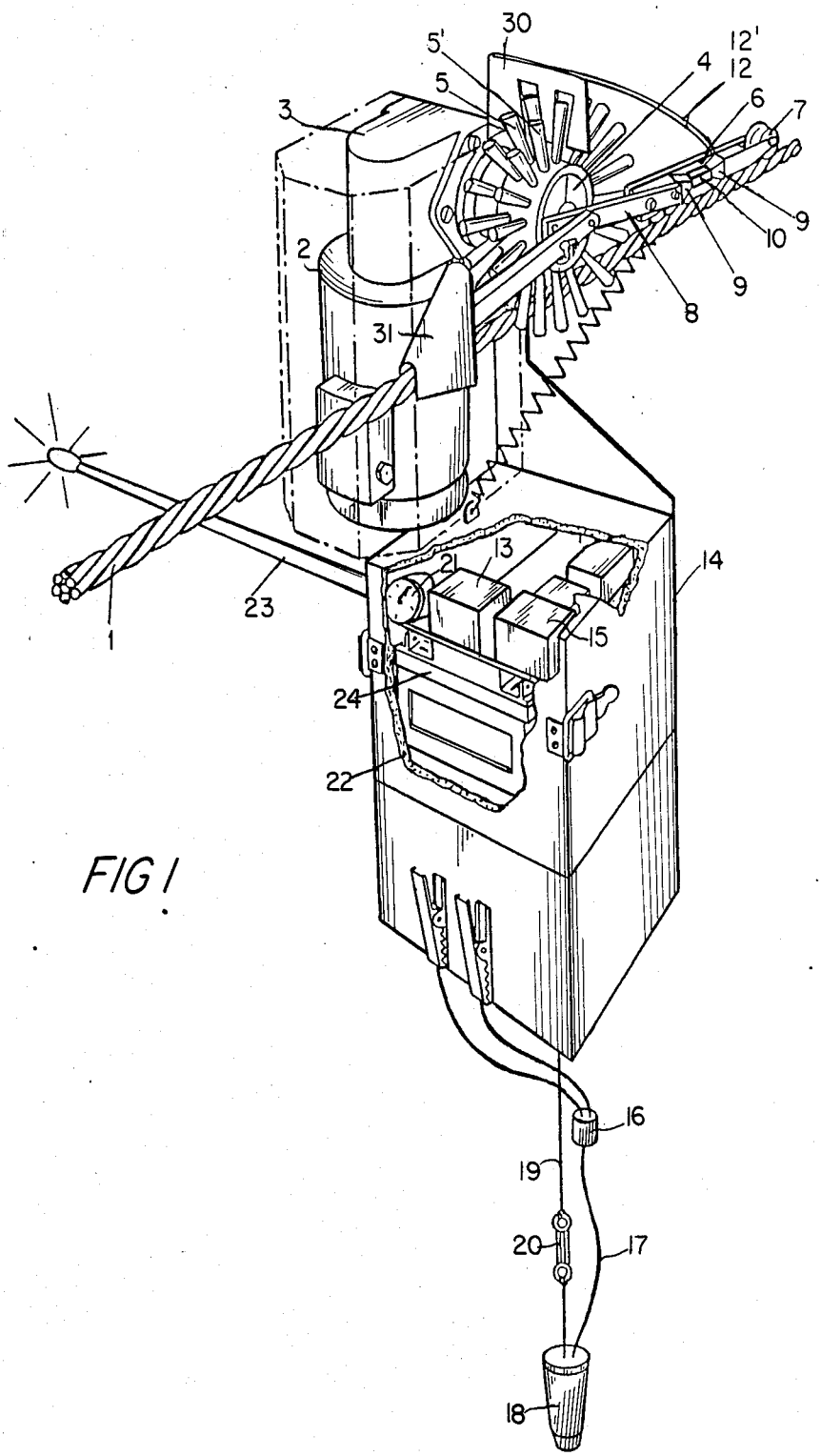
FIG. 1 is a perspective view of a self-driven cable transporting unit in accordance with the present invention.

FIG. 1 illustrates a preferred embodiment of the present invention for transporting explosives by cable. Transport is accomplished by self-driven transporting unit T mounted for movement along fixed cable 1. Cable 1 is formed of hardened steel strands twisted together in any conventional manner. The cable is formed with at least one section which is subdivided into discrete magnetized zones of equal length. Each zone may, for example, be 30 millimeters in length and spaced from an adjacnet magnetized zone at, for example, 1 meter.

Figure 2:
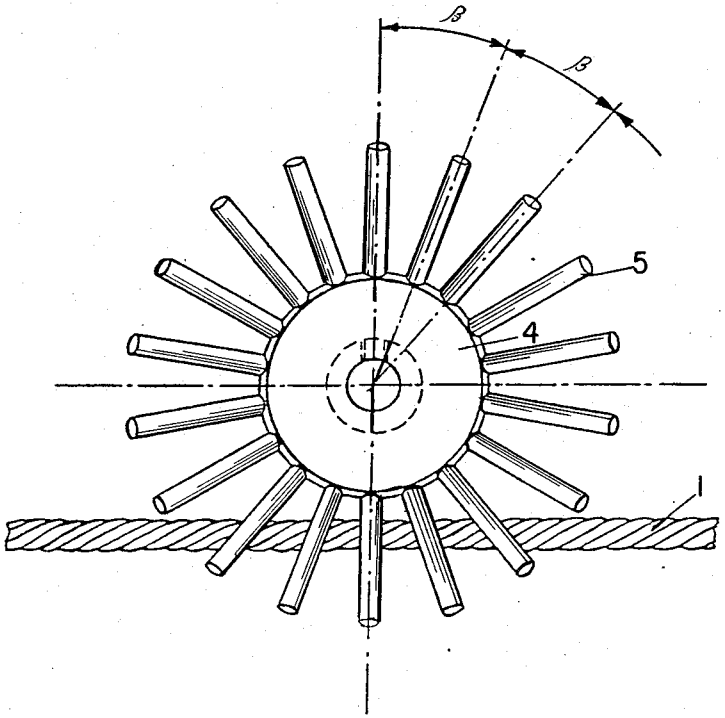
FIG. 2 is a detailed side view on a larger scale of the drive wheel of the self-driven transporting unit illustrated in FIG. 1.

Self-driven transporting unit T includes electric motor 2 which can be of the compound type, for example, having a very poor shunt. Screw reducing gear 3 is arranged above motor 2 and connects drive wheel 4 to the motor. The outer circumference of wheel 4 is provided with two rows of spokes 5 and 5[1] which are angled toward each other in the direction of the wheel such that a pair of spokes located in opposite rows and being disposed along the same radial cross-sectional plane form a divergently angled pair (see FIG. 3). The divering pairs serve as an engaging means for the transporting unit by firmly and substantially encompassing cable 1 when the transporting unit passes over that portion of the cable. In addition, the ability of spokes 5 and 5[1] to grip cable 1 is enhanced by spacing the spokes along the circumference of wheel 4 such that the space separating adjacent spokes is a multiple of at least 1 by the pitch of the cable. As a result, the spokes firmly engage at advantageous points along the twist of the cable (see FIG. 2).

Magnetic detector 6 is attached to one end of self-driven transporting unit T for detecting the magnetized cable zones passed over by the transport. Nylon rubber runner 7 is attached to one end of magnetic detector 6 and is provided to roll along cable 1 thereby holding magnetic detector 6 close to the cable. In addition, holding rod 8 secures magnetic detector 6 to the axle of drive wheel 4.

Figure 4:
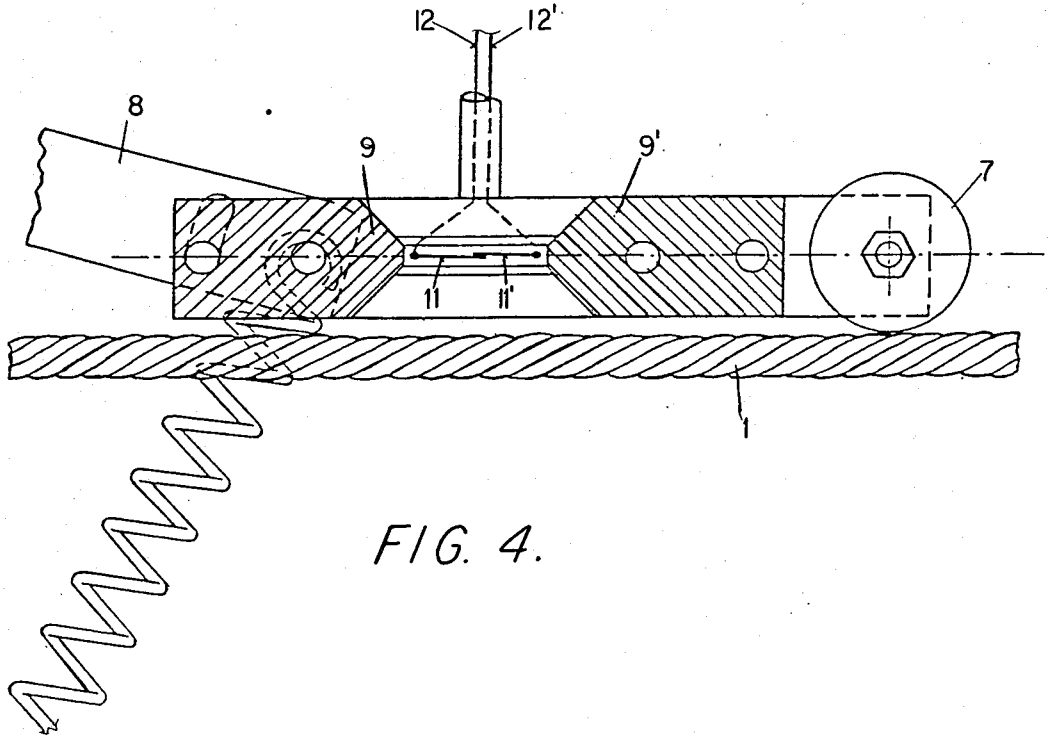
FIG. 4 is a partial plan view of the magnetic detector of the self-driven transporting unit of the present invention.
Figure 5:
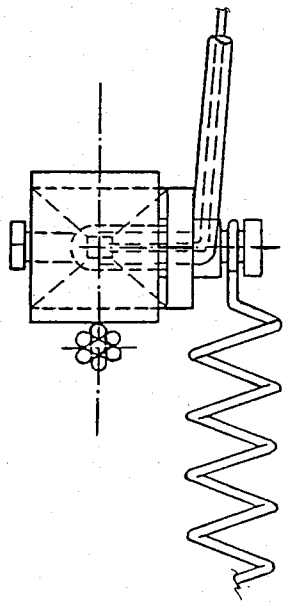
FIG. 5 is an end view taken along line A—A of the distance detector illustrated in FIG. 4.

As shown in greater detail in FIGS. 4 and 5, magnetic detector 6 includes feeding heads 9 and 9[1] which are made of soft iron. The feeding heads are positioned on either side of a reed switch assembly which is surrounded by glass tube 10. The reed switch assembly serves as a magnetically actuated contact when transporting unit T passes over the magnetized cable zones. In particular, the reed switch assembly comprises small plates 11 and 11[1] whose adjacent ends are closely spaced. The opposite ends of the small plates are secured to feeding heads 9 and 9[1] and are also connected to wires 12 and 12[1] leading to translation counter 13. Translation counter 13, in turn, is contained within case 14 that is coupled to the frame of electric motor 2 and to the axle of drive wheel 4. Case 14, moreover, contains electronic pulse counter 15 which registers the drop-height of a load attached to winch cable 19. In addition, case 14 contains battery 24 and radio receiver 22 which is linked to aerial 23, a winch (not shown) and time switch 21. The self-driven transporting device is provided with scraper 30 which allows frost or ice that has accumulated between the spokes of the wheel to be removed. Self-driven transport unit T is also provided with front scraper 31 which is intended to effect a preliminary clearing of the cable in the event of frosting.

Figure 3:
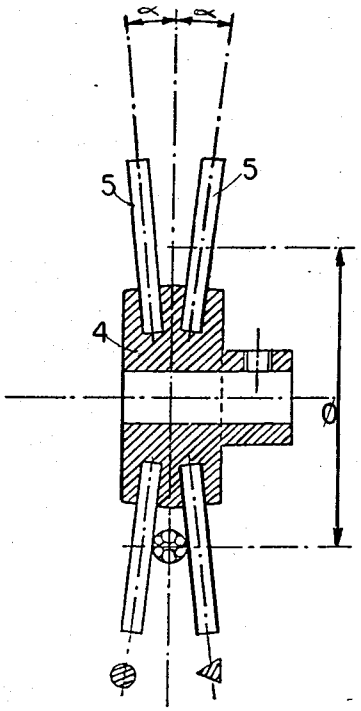
FIG. 3 is a sectional side view of the drive wheel illustrated in FIG. 2.

Owing to the V-shaped spoke arrangement, the transporting device can easily move on heavily frosted cable. The engaging action of the spokes breaks the ice on the cable and allows the spokes to embed into the cable. As a result, the device can ascend sections of heavily frosted cable up to a gradient of 80%. As shown in FIG. 3, the cross-section of spokes 5 and 5' may be circular 33 or triangular 34. The triangular shape is particularly advantageous for breaking through ice coating the cable and firmly embedding the spoke into the ice. However, any other shape may be envisaged. In the preferred embodiment, the opening angle $\alpha$ of spokes 5 and 5[1] was chosen to be 11°. The circumferential angle defined by arrows $\beta$ in FIG. 2 can be any appropriate angle which would result in a spacing of the spokes that would be a multiple of the cable pitch of at least 1.

Due to the simple construction of the present invention, the self-transporting device is extremely lightweight. Transporting device T may, therefore, be carried by hand and may be used on several different installations.

In a preferred embodiment of the present invention, self-driven transporting unit T may be used for transporting explosive charges intended for artificially triggering off avalanches. As shown in FIG. 1, this embodiment includes ignition device 16 connected to slow fuse 17 which, in turn, connects to explosive 18. The explosive is supported by cable 19 which is connected to the winch. Releasable connector 20 is provided along cable 19 and is positioned near the explosive at, for example, a distance of 2 meters. Ignition 16 is connected to case 14 and is, in turn, connected to an appropriate energization source by means of wires 35 and 35[1] which are held to case 14 by clips 36 and 36[1].

In operation, self-driven transporting unit T is initially programmed by pre-selecting the translation distance and drop height through digital readout screens. The screens can be connected to translation counter 13 and electronic counter 15 and controlled by a central processor that is either part of, or separate from, the transporting unit. When self-driven transporting unit is mounted on cable 1, it moves in one direction passing over the magnetized zones of cable 1. When these zones pass underneath magnetic detector 6 small plates 11 and 11[1] close, switching translation pulse counter 13 to an "ON" state until the magnetized zone is passed over. Once translation counter 13 has counted up to the preselected number of programmed pulses equivalent to the desired distance, a contact is established halting electric motor 2 at the preselected translation distance. The winch is then automatically lowered to the drop height programmed into electronic pulse counter 15 and the load is unloaded.

In the preferred embodiment, once explosive 18 has been lowered, ignition 16 ignites slow fuse 17. The slow fuse delays detonation for a sufficient period of time to allow the transporting unit to clear the detonation area. Time switch 21 is then activated to retain the winch in the lowered position for a pre-set time interval. Once the time period on switch 21 has passed, the winch is raised until an end of travel contact triggers off the reverse motion of self-driven transporting unit T. The unit then returns to the point in which it was mounted onto cable 1.

Alternately, radio receiver 22 enables the apparatus to be operated and the explosive to be ignited by remote control as a safety measure. This receiver may be used, for example, when a breakdown erases the programmed electronic system or if the explosion needs to be either delayed or cancelled.

In another alternate embodiment, self-driven transporting unit T can be controlled by wire. The wire can either provide communications for controlling the electronic system of the transporting unit or can also serve as the power source.

The preferred embodiment of self-driven transporting unit T weighs between about 15 to 18 kilograms. An explosive charge of up to 5 kilograms can be transported by this system. The self-driven transporting unit and multiple charges, therefore, may be carried in a rucksack to the mounting point enabling the system to be used on one or several different installations.

Although the invention has been described with respect to particular means, materials and embodiments, it is to be understood that the invention is not limited to the particulars disclosed and extends to encompass all equivalent embodiments falling within the scope of the claims.

What is claimed is:

1. A cable transporting apparatus comprising a self-driven transporting unit adapted to travel along a cable, wherein said unit comprises at least one drive wheel having two rows of engaging means positioned along the circumference of said drive wheel to engage both sides of said cable by gripping said cable for moving said transporting unit along said cable, said transporting unit further comprising a motor for driving said drive wheel, wherein said transporting unit is driven along said cable in response to rotation of said drive wheel by said motor, wherein said engaging means comprises a series of radially extending spokes mounted about the circumference of said drive wheel wherein one end of each of said spokes is attached to said drive wheel.

2. The apparatus of claim 1 wherein said self-driven transporting unit weighs about 15 to 18 kilograms enabling said self-driven transporting unit to be carried by hand.

3. The apparatus of claim 1 wherein said spokes are arranged in two rows which are evenly spaced apart about the circumference of said drive wheel and each spoke of one row is opposite to a spoke in the other row such that every spoke is paired.

4. The apparatus of claim 1 wherein said rows diverge to form a V-shape along a radial cross-sectional plane.

5. The apparatus of claim 4 wherein said spokes are circumferentially spaced around said drive wheel by a multiple of at least 1 of the pitch of said cable.

6. The apparatus of claim 4 wherein the opening angle of said diverging rows is about 11 degrees.

7. The apparatus of claim 6 wherein said spokes are adapted to break ice coating said cable thereby allowing said spokes to embed into the ice.

8. The apparatus of claim 7 wherein each of said spokes has a triangular cross-section adapted to break through ice on a frost-coated cable and embed said spoke firmly into the ice.

9. The apparatus of claim 7 wherein each of said spokes has a circular cross-section.

10. The apparatus of claim 7 further comprising a spoke scraper plate attached to said drive wheel for scraping material off of each of said spokes when said drive wheel is rotated; and a front scraper plate attached to said self-driven transporting unit for clearing excess material off of said cable.

11. The apparatus of claim 1 further comprising a winch for raising and lowering a load carried by said self-driven transporting unit wherein said winch is contained in a case coupled to said self-driven transporting unit, wherein said case further comprises an electronic pulse counter which registers the drop height of a load carried by said self-driven transporting unit when said load is raised or lowered by said winch; a radio receiver for receiving communications from a remote control device; and an aerial attached to the exterior of said case and connected to said radio receiver for directing communications to the radio receiver in order to permit remote control of said self-driven transporting unit.

12. A cable transporting apparatus comprising a self-driven transporting unit adapted to travel along a cable, wherein said unit comprises at least one drive wheel having two rows of engaging means positioned along the circumference of said drive wheel to engage both sides of said cable by gripping said cable for moving said transporting unit along said cable, said transporting unit further comprising a motor for driving said drive wheel, wherein said transporting unit is driven along said cable in response to rotation of said drive wheel by said motor, wherein said unit further comprises a compound type electric motor and a screw reducing gear attaching said motor to said drive wheel, wherein said transporting unit comprises a reed-type magnetic detector which senses magnetized zones along said cable, said magnetic detector comprising a holding rod connecting said detector to said self-driven transporting unit; a nylon runner which is adapted to roll along said cable and hold said reed-type magnetic detector closely to said cable; a pair of soft iron feeding heads which form a housing for said reed-type magnetic detector; and a reed switch assembly.

13. The apparatus of claim 12 wherein said reed switch assembly comprises two small plates whose ends are separated by a small space; two wires connecting the end of each plate to a translation counter; and a glass tube surrounding said small plates whereby when said magnetized zone is passed over the small plates contact one another energizing the translation counter until said self-driven transporting unit passes over said non-magnetized zone.

14. The apparatus of claim 13 wherein said translation counter is positioned in a case which is coupled to said compound type electric motor, said case further containing a battery for energizing said self-driven transporting unit.

15. A cable transporting apparatus comprising a cable and a self-driven transporting unit which travels along said cable and is provided with at least one drive wheel having an engaging means which engages with said cable, wherein said self-driven transporting unit is adapted to transport an explosive, said apparatus further comprising: a winch and winch cable which raises and lowers said explosive; an ignition device connected to said self-driven transporting unit; a slow fuse having said explosive attached to one end and having an opposite end attached to said ignition device for delaying detonation of said explosive for a period of time that is sufficient to enable said self-driven transporting unit to clear a detonation area; and a release connection having one end attached to said winch cable and an opposite end attached to said explosive such that said explosive can be released from said self-driven transporting unit through said connection.

16. A method for transporting a load by cable in an apparatus comprising: a programmable self-driven transporting unit; a cable mounted in a fixed manner and magnetized into discrete magnetic zones; a magnetic detector attached to said self-driven transporting unit for sensing the position of said self-driven transporting unit along said cable, and an automatic winch attached to said self-driven transporting unit for raising and lowering a load, said method comprising:

(a) attaching a load to said self-driven transporting unit;
(b) moving said load over a pre-determined number of said magnetized zones that are equivalent to a pre-selected distance;
(c) lowering said load by said automatic winch to a pre-selected height;
(d) releasing said load; and
(e) returning said self-driven transporting unit along said cable, wherein said method further comprises the steps of transporting and detonating an explosive by cable by attaching an explosive to said self-driven transporting unit; lowering said explosive by said automatic winch to said pre-selected height once said pre-selected distance is reached; and then detonating said explosive.

17. The method of claim 16 further comprising stopping said self-driven transporting unit when the number of magnetized zones passed over by said self-driven transporting unit is equal to said pre-selected distance programmed into said self-driven transporting unit.

18. The method of claim 17 further comprising respectively programming said pre-selected distance and said pre-selected height into a translation counter and an electronic pulse counter by using digital readout screens which are attached to said counters and which are controlled by a central processing unit such that during operation said self-driven transporting unit counts an equivalent number of said magnetized zones and an equivalent length of said winch cable in the counters in order to control the distance that the load is transported and the height that the load is dropped.

19. The method of claim 16 comprising returning said self-driven transporting unit by triggering reverse motion in said self-driven transporting unit by means of an end of travel contact.

20. The method of claim 16 further comprising lowering said load by a winch controlled by an electronic pulse counter and a time switch; stopping said winch once the load reaches said pre-selected drop height; maintaining said winch in a stopped condition for a time period controlled by said time switch; and raising said winch once said time period has ended.

21. The method of claim 16 comprising remotely controlling said self-driven transporting unit through radio frequency communications transmitted by an operator and received by an aerial and radio receiver located on said self-driven transporting unit.

22. A cable transporting apparatus comprising a cable and a self-driven transporting unit which travels along said cable wherein said unit comprises at least one drive wheel having an engaging means which engages with said cable, and means for driving said drive wheel positioned on said transporting unit, wherein said cable has at least one section subdivided into discrete magnetized zones of equal length and which are separated along the length of said cable by non-magnetized zones of equal length, wherein said transporting unit further comprises means for counting said magnetic zones passed by said transporting unit along the length of said cable, and means for activating and deactivating said driving means in response to said counting means counting a predetermined number of magnetic zones along the length of said cable.

23. The apparatus of claim 22 wherein said transporting unit comprises a reed-type magnetic detector which senses magnetized zones along said cable, said magnetic detector comprising a holding rod connecting said detector to said self-driven transporting unit; a nylon runner which is adapted to roll along said cable and hold said reed-type magnetic detector closely to said cable; a pair of soft iron feeding heads which form a housing for said reed-type magnetic detector; and a reed switch assembly.

24. The apparatus of claim 23 wherein said reed switch assembly comprises two small plates whose ends are separated by a small space; two wires connecting the end of each plate to a translation counter; and a glass tube surrounding said small plates whereby when said magnetized zone is passed over the small plates contact one another energizing the translation counter until said self-driven transporting unit passes over said non-magnetized zone.

25. The apparatus of claim 24 wherein said translation counter is positioned in a case which is coupled to said driving means, said case further containing a battery for energizing said self-driven transporting unit.

26. A method of transporting a self-driven transporting unit along a cable comprising the steps of:

engaging and gripping two sides of said cable with two rows of radially extending spokes positioned along the circumference of a drive wheel of said transporting unit and attached at one end to said drive wheel; and rotating said drive wheel with a motor on said transporting unit, thereby rotating said spokes on two sides of said cable and displacing said transporting unit along the length of said cable.

27. A method of transporting a self-driven transporting unit along a cable comprising the steps of:

engaging and gripping two sides of said cable with two rows of engaging means positioned along the circumference of a drive wheel of said transporting unit;

rotating said drive wheel with a motor on said transporting unit, thereby rotating said engaging means on two sides of said cable and displacing said transporting unit along the length of said cable;

magnetizing at least one section of said cable over which said unit travels into discrete magnetic zones;

programming said unit to travel a desired distance;

moving said unit over said discrete magnetic zones;

counting said magnetic zones sensed through a magnetic sensor; and stopping said unit at the number of counted zones equivalent to said desired distance.

28. A cable transporting apparatus comprising a self-driven transporting unit which travels along a cable, wherein said unit comprises:

at least one drive wheel comprising engaging means for engaging said cable, wherein said engaging means comprises a plurality of spokes extending from the circumference of said drive wheel;

a spoke scraper plate attached to said drive wheel for scraping material off of each of said spokes when said drive wheel is rotated; and a front scraper plate attached to said self-driven transporting unit for clearing excess material off of said cable.

* * * * *